US011091976B2

(12) United States Patent
Yu

(10) Patent No.: US 11,091,976 B2
(45) Date of Patent: Aug. 17, 2021

(54) SETTING TOOL FOR SETTING BRIDGE PLUG

(71) Applicant: WELLRAY TECHNOLOGIES CO., LTD., Beijing (CN)

(72) Inventor: Zhihua Yu, Beijing (CN)

(73) Assignee: WELLRAY TECHNOLOGIES CO., LTD., Beijing (CN)

( * ) Notice: Subject to any disclaimer, the term of this patent is extended or adjusted under 35 U.S.C. 154(b) by 236 days.

(21) Appl. No.: 16/314,519

(22) PCT Filed: Feb. 6, 2017

(86) PCT No.: PCT/CN2017/072964
§ 371 (c)(1),
(2) Date: Apr. 16, 2019

(87) PCT Pub. No.: WO2018/000815
PCT Pub. Date: Jan. 4, 2018

(65) Prior Publication Data

US 2019/0249513 A1 Aug. 15, 2019

(30) Foreign Application Priority Data

Jun. 30, 2016 (CN) ..... 201610512282.2

(51) Int. Cl.
*E21B 33/134* (2006.01)

(52) U.S. Cl.
CPC ..... *E21B 33/134* (2013.01)

(58) Field of Classification Search
CPC ..... E21B 33/134
See application file for complete search history.

(56) References Cited

U.S. PATENT DOCUMENTS 6,050,349 A * 4/2000 Rountree ..... E21B 47/20 175/40
2011/0000676 A1* 1/2011 Brandsdal ..... E21B 29/00 166/317

(Continued)

FOREIGN PATENT DOCUMENTS

CN 102635328 A 8/2012
CN 103452526 A 12/2013

(Continued)

OTHER PUBLICATIONS

International Search Report corresponding to Application No. PCT/CN2017/072964; dated May 10, 2017.

*Primary Examiner* — Silvana C Runyan
(74) *Attorney, Agent, or Firm* — Cantor Colburn LLP

(57) ABSTRACT

A cable-type bridge plug setting and sealing tool, including a series of sequentially connected components provided in the following order: an upper connector, a driver, a control valve, a hydraulic actuator, and a piston adapter. When the control valve is in a first state, the driver sends, according to a first direction, a hydraulic fluid to the hydraulic actuator, thereby causing the hydraulic actuator to actuate a downward extension of the piston adapter. When the control valve is in a second state, the driver sends, according to a second direction, a hydraulic fluid to the hydraulic actuator, thereby causing the hydraulic actuator to actuate an upward retraction of the piston adapter. The cable-type bridge plug setting and sealing tool uses hydraulic control to achieve setting and sealing of a bridge plug, greatly reducing an operational risk coefficient and ensuring a degree of operational safety.

20 Claims, 4 Drawing Sheets

(56) References Cited

U.S. PATENT DOCUMENTS

| | | | | |
|---|---|---|---|---|
| 2014/0209321 | A1* | 7/2014 | Hansen | E21B 33/129<br>166/377 |
| 2015/0275630 | A1 | 10/2015 | Turner | |

FOREIGN PATENT DOCUMENTS

| | | | |
|---|---|---|---|
| CN | 103470214 | A | 12/2013 |
| CN | 204899848 | U | 12/2015 |
| CN | 205918396 | U | 2/2017 |

* cited by examiner

SETTING TOOL FOR SETTING BRIDGE PLUG

CROSS REFERENCE TO RELATED APPLICATIONS

This is the U.S. national stage of International Application No. PCT/CN2017/072964, filed on Feb. 6, 2017. Priority under 35 U.S.C. § 119(a) and 35 U.S.C. § 365(b) is claimed from Chinese Application No. 201610512282.2, filed on Jun. 30, 2016, the disclosures all of which are also incorporated herein by reference.

FIELD

The present application relates to the technical field of petroleum detection, and in particular to a wireline bridge plug setting tool.

BACKGROUND

Well logging is a method for measuring geophysical parameters by utilizing geophysical properties of rock formations, such as electrochemical properties, electrical conductivity properties, acoustic properties, and radioactivity and so on.

During petroleum drilling, well logging is performed after drilling to a designed depth of a well, to obtain various petroleum geological data and engineering data, and these data serve as the original data for well completion and oilfield development. This type of well logging is customarily referred to as open hole logging (logging after well completion). A bridge plug is a tool used to isolate different oil and gas zones in an oil and gas well, which is convenient for mining different oil and gas zones by stages, and has the characteristics of less construction processes, short cycle and accurate clamping and sealing position. There are two types of bridge plugs, namely, a permanent bridge plug and a bridge plug that can be recaptured. Bridge plug setting is a method to convey the bridge plug to a position in the oil and gas well and release the bridge plug to allow it to be fixed in the oil and gas well, by using certain tools. A bridge plug setting tool is configured to convey the bridge plug to a required downhole position and release the bridge plug, and it is an auxiliary tool for pushing and setting the bridge plug.

In the conventional technology, the bridge plug setting tool mainly includes a wireline setting tool and a tubing conveyed setting tool. The current wireline setting tools are mainly gunpowder setting tools.

At present, the gunpowder wireline bridge plug setting tool widely used in domestic was introduced from the United States in the 1980s. A detonator and slow-release explosive are carried in the tool. The detonator and explosive are detonated by electric pulses exerted by the wireline, a high pressure is formed by the explosion of the slow-release explosive, the high pressure is converted into a tensile force by a hydraulic cylinder and a piston, and finally the bridge plug setting is realized.

The conventional gunpowder wireline bridge plug setting tool has the following defects:

firstly, the bridge plug is set by a boosting force generated from the burning of the gunpowder, the construction is difficult, the construction cost is high, and the operation is difficult;

secondly, the gunpowder is used on site, creating a high risk factor and significant potential safety hazard;

in addition, a success rate is low by using the gunpowder to generate the boosting force;

finally, after each use, the bridge plug setting tool is required to be disassembled, and then maintained and filled with gunpowder again, which requires high operational skills, and the procedures are cumbersome.

In view of this, a new type of wireline bridge plug setting tool is designed through a different way from the conventional technology, which decreases the construction difficulty and reduces the potential safety hazard of the bridge plug setting under the premise of ensuring the success rate of the bridge plug setting.

SUMMARY

An object of the present application is to provide a wireline bridge plug setting tool, to realize bridge plug setting by hydraulic control, which improves a success rate of the bridge plug setting, decreases the construction difficulty and construction cost, reduces a risk factor of the construction, thereby avoiding potential safety hazards and ensuring simple operation processes and convenient use.

To solve the above technology problems, a wireline bridge plug setting tool is provided according to the present application, including an upper connecting device, a driving device, a control valve block, a hydraulic actuator, and a push-cylinder adapter, which are connected in sequence.

In a case that the control valve block is in a first state, the driving device is configured to convey hydraulic oil to the hydraulic actuator in a first direction, to allow the hydraulic actuator to drive the push-cylinder adapter to extend downward.

In a case that the control valve block is in a second state, the driving device is configured to convey the hydraulic oil to the hydraulic actuator in a second direction, to allow the hydraulic actuator to drive the push-cylinder adapter to retract upward.

By employing the bridge plug setting tool having this structure, the bridge plug setting is realized by the hydraulic control. Compared with a gunpowder setting tool in the conventional technology, this bridge plug setting tool greatly reduces a risk factor of operation and ensures safety of the operation. Moreover, since stability of hydraulic transmission is high, the bridge plug setting has a high success rate. In addition, the hydraulic bridge plug setting tool has less construction difficulty and lower construction cost, and the difficulty of operation is also reduced. Moreover, compared with the conventional technology, the hydraulic bridge plug setting tool does not need disassembly, maintenance, gunpowder filling and other cumbersome procedures after each use, and thus the hydraulic bridge plug setting tool has simple operation procedures and is convenient to use.

Preferably, the hydraulic actuator is a two-stage hydraulic cylinder including a cylinder, and two pistons and two piston rods are arranged in the cylinder, an upper piston rod is connected to a lower piston, and a spacer ring having a fixed position is provided between an upper piston and the lower piston;

a first cavity is formed between the upper piston and the control valve block, a second cavity is formed between the upper piston and the spacer ring, a third cavity is formed between the spacer ring and the lower piston, and a fourth cavity is formed between the lower piston and a lower end cover of the cylinder; and in a case that the control valve block is in the first state, the driving device is configured to convey the hydraulic oil to the first cavity and the third cavity, and the second cavity and the fourth cavity are oil return cavities; in a case that the control valve block is in the second state, the driving device is configured to convey the hydraulic oil to the second cavity and the fourth cavity, and the first cavity and the third cavity are oil return cavities.

Preferably, the control valve block includes a two-position four-way reversing valve;

in a case that the reversing valve is in a first position, an output end of the driving device, an oil inlet of the reversing valve and a first oil port of the reversing valve are in communication with the first cavity and the third cavity, and an oil return port of the reversing valve, a second oil port of the reversing valve, the second cavity and the fourth cavity are in communication with an oil storage tank; and in a case that the reversing valve is in a second position, the output end of the driving device, the oil inlet and the second oil port are in communication with the first cavity and the second cavity, and the oil return port of the reversing valve, the first oil port of the reversing valve and the second cavity are in communication with the oil storage tank.

Preferably, a check valve is further provided between the driving device and the reversing valve, an opening of the check valve is directed to the reversing valve, and an overflow valve is further provided on a hydraulic branch between the driving device and the check valve.

Preferably, the wireline bridge plug setting tool further includes a detecting member configured for detecting displacement of the piston rods, where the detecting member is arranged at the spacer ring.

Preferably, the driving device includes a motor drive circuit board and a power device, the power device includes a first motor and a hydraulic pump, and an output shaft of the hydraulic pump is connected to the hydraulic actuator through the control valve block.

Preferably, the wireline bridge plug setting tool further includes an outer housing cylinder, the motor drive circuit board and the power device are mounted in the outer housing cylinder, and the outer housing cylinder is provided with an oil filling port between the motor drive circuit board and the power device.

Preferably, the outer housing cylinder is further provided with an exhaust port between the motor drive circuit board and the power device; and a balancing device is further provided between the motor drive circuit board and the power device.

Preferably, the balancing device includes a balancing piston rod and a balancing piston arranged in the outer housing cylinder, and a balancing spring arranged between the balancing piston and the motor.

Preferably, a balancing guide block is further arranged in the outer housing cylinder, a first guide hole is provided in a middle portion of the guide block, and the balancing piston rod is slidably inserted into the first guide hole.

Preferably, the outer housing cylinder is further provided with a pressure receiving plate between the motor drive circuit board and the oil filling port, and the pressure receiving plate is configured to isolate the motor drive circuit board from the balancing device.

Preferably, the push-cylinder adapter includes a guide tube sleeved outside a lower piston rod, an upper end of the guide tube is connected to the lower end cover, a lower end of the guide tube is connected to a bridge plug connector, and the guide tube is provided with a second guide hole extending in an axial direction. The lower piston rod is connected to a lower connector and a push cylinder through a connecting block that radially passes through the second guide hole, and the lower connector and the push cylinder are sleeved outside the guide tube, to allow the lower connector and the push cylinder to move, together with the lower piston rod, with respect to the bridge plug connector, to break a release ring at a bridge plug by pulling, so as to release the bridge plug.

Preferably, an additional release member is provided between the guide tube and the bridge plug connector.

Preferably, the additional release member is a wire configured to connect the guide tube and the bridge plug connector, and the wire is configured to fuse automatically when a current applied to the wire reaches a preset value.

Preferably, the additional release member includes a pin shaft configured to connect the guide tube and the bridge plug connector, a second motor and a lead screw, one end of the lead screw is connected to the second motor, another end of the lead screw is connected to the pin shaft, and the lead screw is configured to be driven by the motor to move, so as to pull out the pin shaft.

Figure 1:
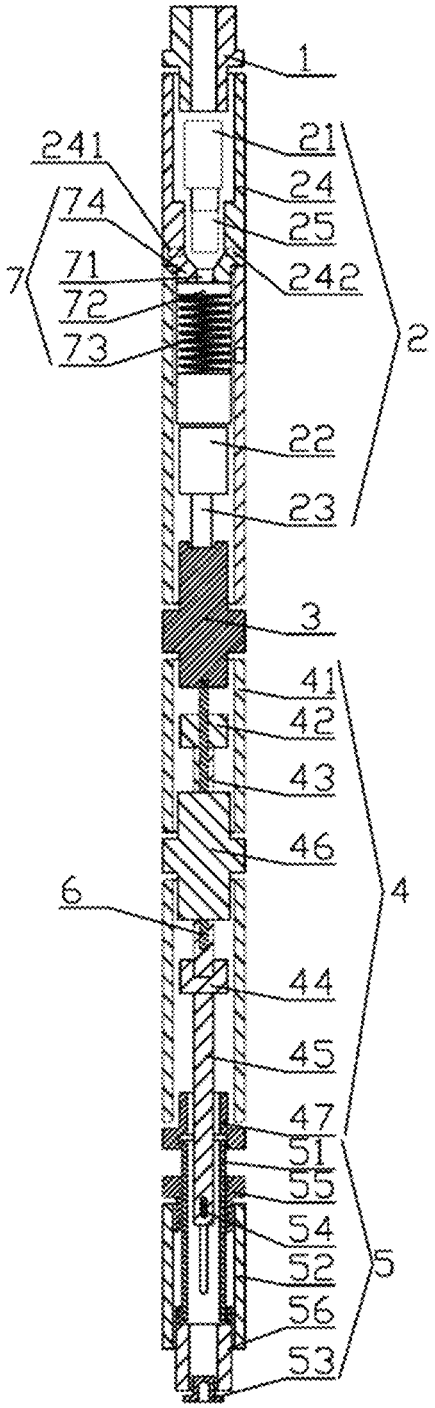
FIG. 1 is a schematic structural view of a wireline bridge plug setting tool according to a specific embodiment of the present application.

Reference numerals in FIGS. 1 to 5:

| | | | |
|---|---|---|---|
| 1 | upper connecting device, | | |
| 2 | driving device, | 21 | motor drive circuit board, |
| 22 | first motor, | 23 | hydraulic pump, |
| 24 | outer housing cylinder, | 241 | oil filling port, |
| 242 | exhaust port, | 25 | pressure receiving plate, |
| 3 | control valve block, | 31 | reversing valve, |
| a | oil inlet, | b | first oil port, |
| c | second oil port, | d | oil return port, |
| 32 | check valve, | 33 | overflow valve, |
| 4 | hydraulic actuator, | 41 | cylinder, |
| 42 | upper piston, | 43 | upper piston rod, |
| 44 | lower piston, | 45 | lower piston rod, |
| 46 | spacer ring, | 47 | lower end cover, |
| A | first cavity, | B | second cavity, |
| C | third cavity, | D | fourth cavity, |
| 5 | push-cylinder adapter, | 51 | guide tube, |
| 52 | push cylinder, | 53 | bridge plug connector, |
| 54 | connecting block, | 55 | lower connector, |
| 56 | additional release member, | | |
| 6 | detecting member, | | |
| 7 | balancing device, | 71 | balancing piston rod, |
| 72 | balancing piston, | 73 | balancing spring, |
| 74 | balancing guide block, | | |
| 100 | bridge plug, | 101 | slip, |
| 200 | inner wall of casing tube. | | |

DETAILED DESCRIPTION

A core of the present application is to provide a wireline bridge plug setting tool, to realize bridge plug setting by hydraulic control, which improves a success rate of the bridge plug setting, decreases construction difficulty and construction cost, reduces a risk factor of the construction, thereby avoiding potential safety hazards and ensuring simple operation processes and convenient use.

In order to make those skilled in the art better understand technical solutions according to the present application, the present application will be further described in detail hereinafter in conjunction with drawings and specific embodiments.

It should be noted that, the orientation words "upper" and "lower" in this application are all provided according to states of the wireline bridge plug setting tool in downhole operations, and should not limit the scope of protection of the present application.

Figure 2:
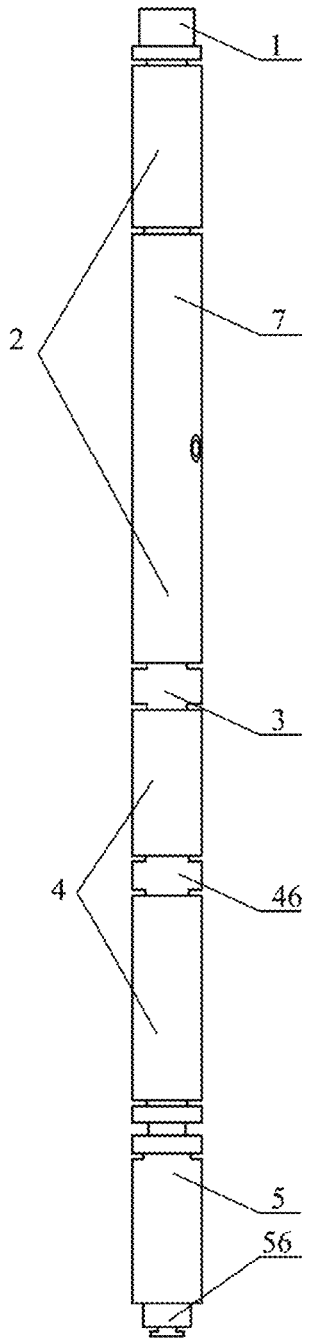
FIG. 2 is an outline view of the wireline bridge plug setting tool shown in FIG. 1.

References are made to FIGS. 1 and 2, FIG. 1 is a schematic structural view of a wireline bridge plug setting tool according to a specific embodiment of the present application; and FIG. 2 is an outline view of the wireline bridge plug setting tool shown in FIG. 1.

In a specific embodiment, as shown in FIGS. 1 and 2, a wireline bridge plug setting tool is provided according to the present application. The wireline bridge plug setting tool includes an upper connecting device 1, a driving device 2, a control valve block 3, a hydraulic actuator 4, and a push-cylinder adapter 5, which are connected in sequence from top to bottom.

The upper connecting device 1 is configured to connect the bridge plug setting tool to other instruments or wireline connectors, so as to realize adaptive connection between the bridge plug setting tool and other instruments. The driving device 2 is configured to supply power for the bridge plug setting tool. The control valve block 3 is configured to control a direction in which the driving device 2 conveys hydraulic oil to the hydraulic actuator 4. The hydraulic actuator 4 is configured to drive, under a positive pressure of the hydraulic oil, the push-cylinder adapter 5 to push downward, or to drive, under an inverted pressure of the hydraulic oil, the push-cylinder adapter 5 to retract upward. The push-cylinder adapter 5 arranged at a lower portion is configured to be connected to a bridge plug, and release the bridge plug when the push-cylinder adapter 5 moves downward to reach a proper position under the driving of the hydraulic actuator 4, so as realize bridge plug setting.

Specifically, in a case that the control valve block 3 is in a first state, the driving device 2 conveys the hydraulic oil to the hydraulic actuator 4 in a first direction, so that the hydraulic actuator 4 drives the push-cylinder adapter 5 to extend downward, thereby realizing the bridge plug setting. In a case that the control valve block 3 is in a second state, the driving device 2 conveys the hydraulic oil to the hydraulic actuator 4 in a second direction, so that the hydraulic actuator 4 drives the push-cylinder adapter 5 to retract upward, thereby realizing recapture of the bridge plug setting tool.

By employing the bridge plug setting tool having the above structure, the bridge plug setting is realized by the hydraulic control. Compared with a gunpowder setting tool in the conventional technology, this bridge plug setting tool greatly reduces a risk factor of operation and ensures safety of the operation. Moreover, since stability of hydraulic transmission is high, the bridge plug setting has a high success rate. In addition, the hydraulic bridge plug setting tool has less construction difficulty and lower construction cost, and the difficulty of operation is also reduced. Moreover, compared with the conventional technology, the hydraulic bridge plug setting tool does not need disassembly, maintenance, gunpowder filling and other cumbersome procedures after each use, and thus has simple operation procedures and is convenient to use.

A specific structure of the above hydraulic actuator 4 may be further arranged.

Figure 3:
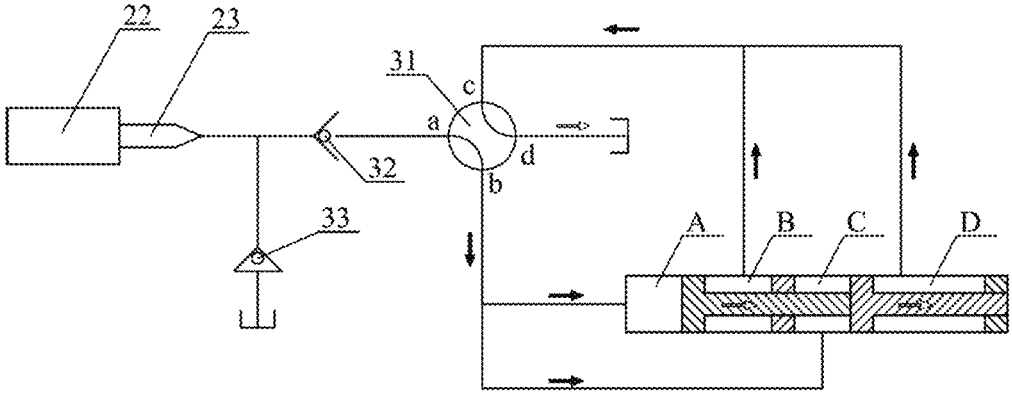
FIG. 3 is a diagram showing the operating principle of the wireline bridge plug setting tool in FIG. 1 being in a pushing state.
Figure 4:
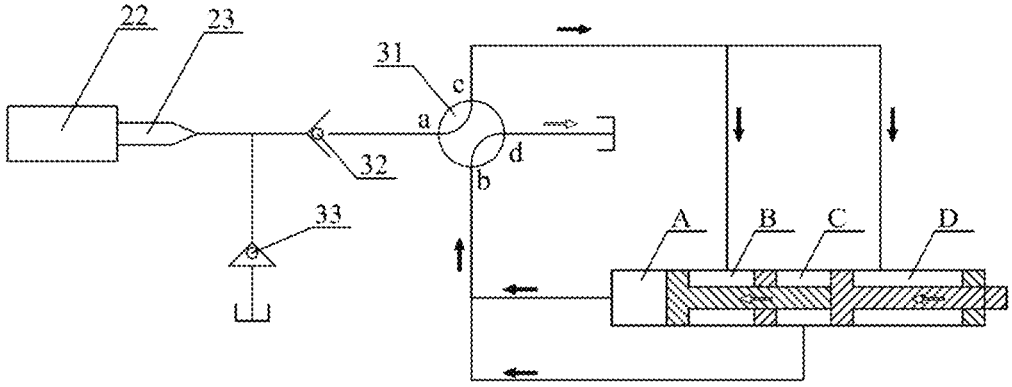
FIG. 4 is a diagram showing the operating principle of the wireline bridge plug setting tool in FIG. 1 being in a retraction state.

References are made to FIGS. 1, 3 and 4, FIG. 3 is a diagram showing the operating principle of the wireline bridge plug setting tool in FIG. 1 being in a pushing state; and FIG. 4 is a diagram showing the operating principle of the wireline bridge plug setting tool in FIG. 1 being in a retraction state.

According to a specific technical solution, the hydraulic actuator 4 is a two-stage hydraulic cylinder including a cylinder 41. Two pistons and two piston rods are arranged in the cylinder 41, an upper piston rod 43 is connected to a lower piston 44, and a spacer ring 46 having a fixed position is provided between an upper piston 42 and the lower piston 44. A first cavity A is formed between the upper piston 42 and the control valve block 3, a second cavity B is formed between the upper piston 42 and the spacer ring 46, a third cavity C is formed between the spacer ring 46 and the lower piston 44 and a fourth cavity D is formed between the lower piston 44 and a lower end cover 47 of the cylinder 41.

In a case that the control valve block 3 is in the first state, the hydraulic oil is conveyed to the first cavity A and the third cavity C by the driving device 2, and the second cavity B and the fourth cavity D are oil return cavities. The first cavity A and the third cavity C are continuously increased under a pressure of the hydraulic oil, thereby pushing the two pistons and the two piston rods to push downward, to drive the push-cylinder adapter 5 to move to a required position. At the same time, the second cavity B and the fourth cavity D are continuously decreased, and redundant hydraulic oil flows back to an oil storage tank.

In a case that the control valve block 3 is in the second state, the hydraulic oil is conveyed to the second cavity B and the fourth cavity D by the driving device 2, and the first cavity A and the third cavity C are oil return cavities. The second cavity B and the fourth cavity D are continuously increased under the pressure of the hydraulic oil, thereby pushing the two pistons and the two piston rods to retract upward, to drive the push-cylinder adapter 5 to move upward. At the same time, the first cavity A and the third cavity C are continuously decreased, and the redundant hydraulic oil flows back to the oil storage tank.

It can be seen from the above operation that, by employing the two-stage hydraulic cylinder to serve as the hydraulic actuator 4, under a condition of a constant pressure and an equal outer diameter, areas of the pistons are increased, and thus push-pull forces of the pistons are increased, and push-pull strokes of the piston rods are increased, which can meet the requirements that a stroke of the bridge plug setting is large. Moreover, by employing the two-stage hydraulic cylinder, the two pistons are connected through the piston rods, connection reliability of the piston rods is enhanced, and the spacer ring 46 plays a certain role in supporting the piston rods. Compared with a single-stage hydraulic cylinder having a long piston rod, unstable phenomena such as deflection due to an excessive length of the piston rod are avoided.

A specific structure of the control valve block 3 may be further arranged.

In a specific embodiment, as shown in FIGS. 3 and 4, the control valve block 3 may include a two-position four-way reversing valve 31.

As shown in FIG. 3, in a case that the reversing valve 31 is in a first position, an output end of the driving device 2, an oil inlet a of the reversing valve 31 and a first oil port b of the reversing valve 31 are in communication with the first cavity A and the third cavity C, and an oil return port d of the reversing valve 31, a second oil port c of the reversing valve 31, the second cavity B and the fourth cavity D are in communication with the oil storage tank, thereby realizing downward pushing of the piston rods.

As shown in FIG. 4, in a case that the reversing valve 31 is in a second position, the output end of the driving device 2, the oil inlet a and the second oil port c are in communication with the second cavity B and the fourth cavity D, and the oil return port d of the reversing valve 31, the first oil port b of the reversing valve 31, the first cavity A and the third cavity C are in communication with the oil storage tank, thereby realizing upward retraction of the piston rods.

By employing the two-position four-way reversing valve 31, upward and downward reciprocating motions of the piston rods may be easily and conveniently achieved. The two-position four-way reversing valve 31 may be manually switched or automatically switched. It is conceivable that, the above control valve block 3 is not limited to the two-position four-way reversing valve 31, and other reversing valves may also be provided.

According to a further technical solution, as shown in FIGS. 3 and 4, the control valve block 3 may further include a check valve 32 arranged between the driving device 2 and the reversing valve 31. An opening of the check valve 32 is directed to the reversing valve 31, and an overflow valve 33 is further provided on a hydraulic branch between the driving device 2 and the check valve 32.

A function of the check valve 32 is to allow the hydraulic oil to flow only from the driving device 2 to the reversing valve 31, and not allow the hydraulic oil in the reversing valve 31 to flow reversely, thereby avoiding unstable phenomena. The overflow valve 33 is a pressure control valve. An opening pressure is preset, in a case that an output pressure of the driving device 2 is greater than the opening pressure, redundant hydraulic oil is unloaded through the overflow valve 33, thus ensuring that the output pressure of the driving device 2 is constant, and thereby avoiding a phenomenon of unstable movements of the piston rods due to sudden fluctuations of the output pressure of the driving device 2.

In addition, the wireline bridge plug setting tool may further include a detecting member 6 configured for detecting displacement of the piston rods, and the detecting member 6 is arranged at the spacer ring 46.

The strokes of the piston rods can be accurately detected by the detecting member 6, which facilitates accurate control of the position of the bridge plug. Specifically, the detecting member 6 may be a displacement sensor. Of course, other devices capable of detecting the displacement may also be used.

A specific structure of the driving device 2 may be further arranged.

In another specific embodiment, as shown in FIG. 1, the driving device 2 includes a motor drive circuit board 21 and a power device, the power device includes a first motor 22 and a hydraulic pump 23, and an output shaft of the hydraulic pump 23 is connected to the hydraulic actuator 4 through the control valve block 3.

The motor drive circuit board 21 is used for communication, control, and transmission of downhole motors. The first motor 22 is configured to supply power for the bridge plug setting tool, and the first motor 22 may specifically be a direct current motor or an alternating current motor. The hydraulic pump 23 is configured to rotate under power of the first motor 22, so as to convey the hydraulic oil to the hydraulic actuator 4.

According to a further solution, the driving device 2 further includes an outer housing cylinder 24, the motor drive circuit board 21 and the power device are mounted in the outer housing cylinder 24, and the outer housing cylinder 24 is provided with an oil filling port 241 between the motor drive circuit board 21 and the power device.

Both the motor drive circuit board 21 and the power device are mounted in the outer housing cylinder 24, and thereby the driving device 2 is highly integrated. The oil filling port 241 is provided herein, which is convenient for the hydraulic oil to enter an inside of the bridge plug setting tool and flow into an inside of the control valve block 3 through the first motor 22 and the hydraulic pump 23.

According to a further solution, the outer housing cylinder 24 is further provided with an exhaust port 242 between the motor drive circuit board 21 and the power device; and a balancing device 7 is further provided between the motor drive circuit board 21 and the power device.

The exhaust port 242 is configured to release the air in the hydraulic oil inside the bridge plug setting tool, so as to ensure a vacuum degree of the hydraulic oil. In addition, since the exhaust port 242 is in communication with an inside and an outside of the outer housing cylinder 24, when the bridge plug setting tool is in downhole operation, a pressure inside the bridge plug setting tool varies with changes of a downhole liquid column and an outside pressure. By using the balancing device 7, it is ensured that components inside the bridge plug setting tool will not be crushed due to the excessive outside pressure.

Specifically, the balancing device 7 includes a balancing piston rod 71 and a balancing piston 72 arranged in the outer housing cylinder 24, and a balancing spring 73 arranged between the balancing piston 72 and the first motor 22.

In a case that a pressure outside the outer housing cylinder 24 is suddenly increased or decreased, the balancing spring 73 may be pushed to contract or extend, and to move up and down, and thus the balancing piston 72 is driven to move up and down, so as to balance a pressure difference inside the bridge plug setting tool, thereby functioning to buffer pressure fluctuations, and preventing the components from being crushed due to the excessive outside pressure.

According to a further solution, a balancing guide block 74 is further arranged in the outer housing cylinder 24, a first guide hole is provided in a middle portion of the guide block, and the balancing piston rod 71 is slidably inserted into the first guide hole.

In this way, the balancing piston rod 71 always reciprocates in the first guide hole, which plays a guiding role, thereby ensuring that the balancing spring 73 is compressed or extended both in an axial direction, which avoids unstable phenomena such as radial bending of the balancing spring 73, and further ensures working stability of the balancing device 7.

According to another specific embodiment, the outer housing cylinder 24 is further provided with a pressure receiving plate 25 between the motor drive circuit board 21 and the oil filling port 241, and the pressure receiving plate 25 is configured to isolate the motor drive circuit board 21 from the balancing device 7.

With the pressure receiving plate 25, the hydraulic oil entering the inside of the bridge plug setting tool through the oil filling port 241 cannot reach the motor drive circuit board 21. Moreover, in a case that the balancing device 7 fails, the pressure receiving plate 25 can withstand the pressure outside the setting tool, and thereby protecting the motor drive circuit board 21 from being damaged. In addition, the pressure receiving plate 25 also functions to connect the motor drive circuit board 21 and the first motor 22, thus achieving functions such as communication control and the like.

A specific structure of the push-cylinder adapter 5 may be further arranged.

Figure 5:
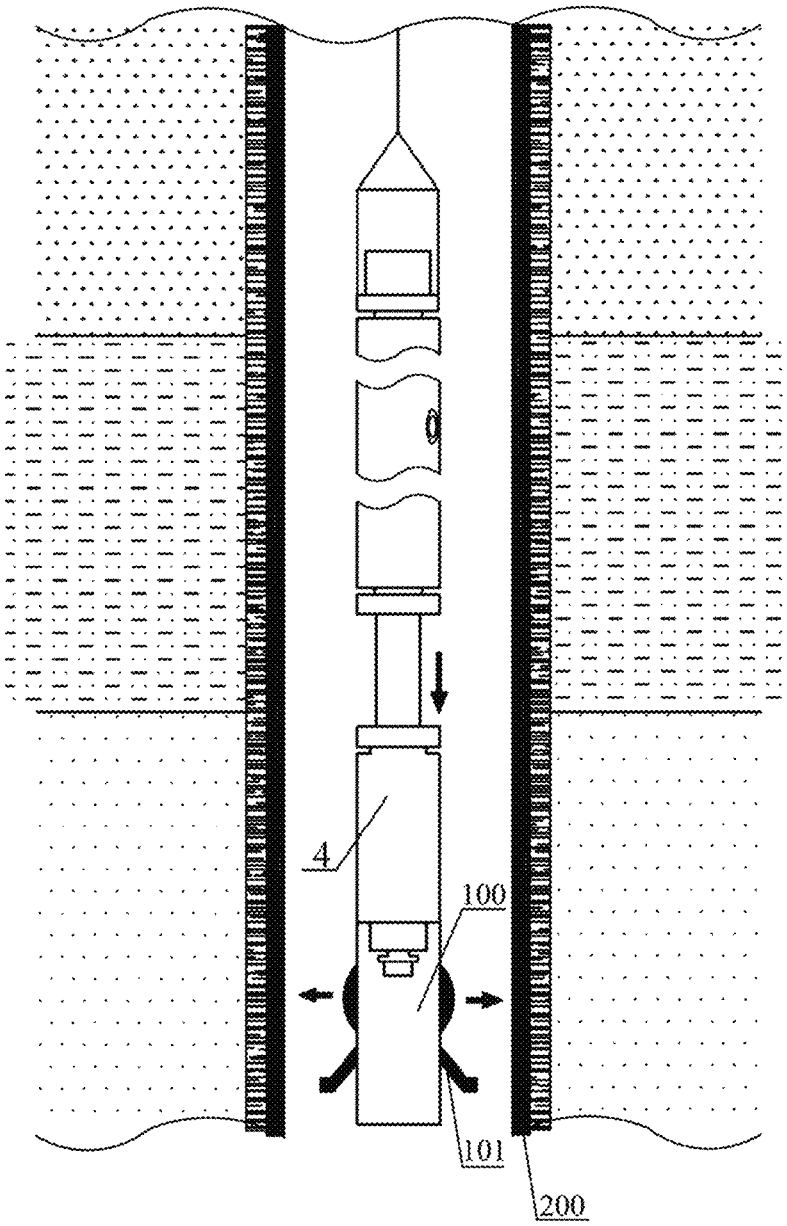
FIG. 5 is a view showing a downhole operating state of the wireline bridge plug setting tool in FIG. 1 and a bridge plug.

References are made to FIGS. 1 and 5, FIG. 5 is a view showing a downhole operating state of the wireline bridge plug setting tool in FIG. 1 and a bridge plug.

According to another specific embodiment, the push-cylinder adapter 5 includes a guide tube 51 sleeved outside a lower piston rod 45, an upper end of the guide tube 51 is connected to the lower end cover 47, a lower end of the guide tube 51 is connected to a bridge plug connector 53, and the guide tube 51 is provided with a second guide hole extending in the axial direction. The lower piston rod 45 is connected to a lower connector 55 and a push cylinder 52 through a connecting block 54 that radially passes through the second guide hole, and the lower connector 55 and the push cylinder 52 are sleeved outside the guide tube 51.

During use, the lower piston rod 45 is pushed downward to extend, the lower connector 55 and the push cylinder 52 move downward together with the lower piston rod 45, and the positions of the guide tube 51 and the bridge plug connector 53 remain unchanged. The push cylinder 52 pushes a bridge plug 100 connected to the bridge plug connector 53 downward until a release ring at the bridge plug 100 is broken by pulling, and thus the bridge plug 100 is released, a slip 101 of the bridge plug 100 is opened and supported on an inner wall 200 of a casing tube to realize the setting of the bridge plug.

Further, an additional release member 56 is provided between the guide tube 51 and the bridge plug connector 53.

Under some special situations, the bridge plug setting tool cannot release the bridge plug, for example, in a case that the bridge plug setting tool is in abnormal operation, or the release ring of the bridge plug cannot be broken by pulling, the additional release member 56 may be used to disconnect the guide tube 51 from the bridge plug connector 53, so that the bridge plug connector 53 is released together with the bridge plug 100, and the setting of the bridge plug can be realized as well.

According to a specific embodiment, the additional release member 56 is a wire connecting the guide tube 51 and the bridge plug connector 53, and the wire may fuse automatically when a current applied to the wire reaches a preset value.

With this structure, in a case that the release ring of the bridge plug cannot be broken by pulling, it is only necessary to apply a current to the wire, when the current reaches a certain value, the wire fuses automatically, thus the bridge plug connector 53 and the bridge plug 100 are released together, and the slip 101 of the bridge plug 100 is opened and supported on the inner wall 200 of the casing tube, and thereby the setting of the bridge plug is realized.

According to another specific embodiment, the additional release member 56 includes a pin shaft configured for connecting the guide tube 51 and the bridge plug connector 53, a second motor and a lead screw, one end of the lead screw is connected to the second motor, another end of the lead screw is connected to the pin shaft, and the lead screw is able to move under the driving of the second motor, so as to pull out the pin shaft.

With this structure, in a case that the release ring of the bridge plug cannot be broken by pulling, it is only necessary to start the second motor to drive the lead screw to rotate, and the lead screw converts rotation of a motor shaft to an axial movement, so as to pull out the pin shaft, to disconnect the bridge plug connector 53 from the guide tube 51, and thereby realizing the setting of the bridge plug.

A wireline bridge plug setting tool according to the present application is described in detail hereinbefore. The principle and the embodiments of the present application are illustrated herein by specific examples. The above description of examples is only intended to help the understanding of the method and the spirit of the present application. It should be noted that, for those skilled in the art, a few of modifications and improvements may be made to the present application without departing from the principle of the present application, and these modifications and improvements are also deemed to fall into the scope of the present application defined by the claims.

The invention claimed is:

1. A setting tool for setting a bridge plug, comprising:

an upper connecting device, a driving device, a control valve block, a hydraulic actuator, and a push-cylinder adapter, which are connected in sequence; wherein the control value block is configured to control a direction in which the driving device conveys hydraulic oil to the hydraulic actuator;

in a case that the control valve block is in a first state, the driving device is configured to convey the hydraulic oil to the hydraulic actuator in a first direction, to allow the hydraulic actuator to drive the push-cylinder adapter connected with the bridge plug to extend downward and release the bridge plug, to realize setting the bridge plug; and in a case that the control valve block is in a second state, the driving device is configured to convey the hydraulic oil to the hydraulic actuator in a second direction, to allow the hydraulic actuator to drive the push-cylinder adapter to retract upward, to realize recapture of the setting tool.

2. The setting tool according to claim 1, wherein the hydraulic actuator is a two-stage hydraulic cylinder comprising a cylinder, and two pistons and two piston rods are arranged in the cylinder, an upper piston rod is connected to a lower piston, and a spacer ring having a fixed position is provided between an upper piston and the lower piston;

a first cavity is formed between the upper piston and the control valve block, a second cavity is formed between the upper piston and the spacer ring, a third cavity is formed between the spacer ring and the lower piston, and a fourth cavity is formed between the lower piston and a lower end cover of the cylinder; and in a case that the control valve block is in the first state, the driving device is configured to convey the hydraulic oil to the first cavity and the third cavity, and the second cavity and the fourth cavity are oil return cavities; in a case that the control valve block is in the second state, the driving device is configured to convey the hydraulic oil to the second cavity and the fourth cavity, and the first cavity and the third cavity are oil return cavities.

3. The setting tool according to claim 2, wherein the control valve block comprises a two-position four-way reversing valve;

in a case that the reversing valve is in a first position, an output end of the driving device, an oil inlet of the reversing valve and a first oil port of the reversing valve are in communication with the first cavity and the third cavity, and an oil return port of the reversing valve, a second oil port of the reversing valve, the second cavity and the fourth cavity are in communication with an oil storage tank; and in a case that the reversing valve is in a second position, the output end of the driving device, the oil inlet and the second oil port are in communication with the second cavity and the fourth cavity, and the oil return port of the reversing valve, the first oil port of the reversing valve, the first cavity and the third cavity are in communication with the oil storage tank.

4. The setting tool according to claim 3, wherein a check valve is further provided between the driving device and the reversing valve, an opening of the check valve is directed to the reversing valve, and an overflow valve is further provided on a hydraulic branch between the driving device and the check valve.

5. The setting tool according to claim 2, further comprising a detecting member configured for detecting displacement of the piston rods, wherein the detecting member is arranged at the spacer ring.

6. The setting tool according to claim 1, wherein the driving device comprises a motor drive circuit board and a power device, the power device comprises a first motor and a hydraulic pump, and an output shaft of the hydraulic pump is connected to the hydraulic actuator through the control valve block.

7. The setting tool according to claim 6, further comprising an outer housing cylinder, wherein the motor drive circuit board and the power device are mounted in the outer housing cylinder, and the outer housing cylinder is provided with an oil filling port between the motor drive circuit board and the power device.

8. The setting tool according to claim 7, wherein the outer housing cylinder is further provided with an exhaust port between the motor drive circuit board and the power device; and a balancing device is further provided between the motor drive circuit board and the power device.

9. The setting tool according to claim 8, wherein the balancing device comprises a balancing piston rod and a balancing piston arranged in the outer housing cylinder, and a balancing spring arranged between the balancing piston and the motor.

10. The setting tool according to claim 9, wherein a balancing guide block is further arranged in the outer housing cylinder, a first guide hole is provided in a middle portion of the guide block, and the balancing piston rod is slidably inserted into the first guide hole.

11. The setting tool according to claim 8, wherein the outer housing cylinder is further provided with a pressure receiving plate between the motor drive circuit board and the oil filling port, and the pressure receiving plate is configured to isolate the motor drive circuit board from the balancing device.

12. The setting tool according to claim 2, wherein the push-cylinder adapter comprises a guide tube sleeved outside a lower piston rod, an upper end of the guide tube is connected to the lower end cover, a lower end of the guide tube is connected to a bridge plug connector, and the guide tube is provided with a second guide hole extending in an axial direction; the lower piston rod is connected to a lower connector and a push cylinder through a connecting block that radially passes through the second guide hole, and the lower connector and the push cylinder are sleeved outside the guide tube, to allow the lower connector and the push cylinder to move, together with the lower piston rod, with respect to the bridge plug connector, to break a release ring at a bridge plug by pulling, so as to release the bridge plug.

13. The setting tool according to claim 12, wherein an additional release member is provided between the guide tube and the bridge plug connector.

14. The setting tool according to claim 13, wherein the additional release member is a wire configured to connect the guide tube and the bridge plug connector, and the wire is configured to fuse automatically when a current applied to the wire reaches a preset value.

15. The setting tool according to claim 13, wherein the additional release member comprises a pin shaft configured to connect the guide tube and the bridge plug connector, a second motor and a lead screw, one end of the lead screw is connected to the second motor, another end of the lead screw is connected to the pin shaft, and the lead screw is configured to be driven by the motor to move, to pull out the pin shaft.

16. The setting tool according to claim 2, wherein the driving device comprises a motor drive circuit board and a power device, the power device comprises a first motor and a hydraulic pump, and an output shaft of the hydraulic pump is connected to the hydraulic actuator through the control valve block.

17. The setting tool according to claim 3, wherein the driving device comprises a motor drive circuit board and a power device, the power device comprises a first motor and a hydraulic pump, and an output shaft of the hydraulic pump is connected to the hydraulic actuator through the control valve block.

18. The setting tool according to claim 4, wherein the driving device comprises a motor drive circuit board and a power device, the power device comprises a first motor and a hydraulic pump, and an output shaft of the hydraulic pump is connected to the hydraulic actuator through the control valve block.

19. The setting tool according to claim 5, wherein the driving device comprises a motor drive circuit board and a power device, the power device comprises a first motor and a hydraulic pump, and an output shaft of the hydraulic pump is connected to the hydraulic actuator through the control valve block.

20. The setting tool according to claim 3, wherein the push-cylinder adapter comprises a guide tube sleeved outside a lower piston rod, an upper end of the guide tube is connected to the lower end cover, a lower end of the guide tube is connected to a bridge plug connector, and the guide tube is provided with a second guide hole extending in an axial direction; the lower piston rod is connected to a lower connector and a push cylinder through a connecting block that radially passes through the second guide hole, and the lower connector and the push cylinder are sleeved outside the guide tube, to allow the lower connector and the push cylinder to move, together with the lower piston rod, with respect to the bridge plug connector, to break a release ring at a bridge plug by pulling, so as to release the bridge plug.

* * * * *